United States Patent [19]

Humpolik et al.

[11] Patent Number: 4,513,587

[45] Date of Patent: Apr. 30, 1985

[54] EVAPORATOR PARTICULARLY SUITABLE FOR AIR CONDITIONERS IN AUTOMOTIVE VEHICLES

[75] Inventors: Bohumil Humpolik, Ludwigsburg; Karl-Heinz Staffa, Stuttgart, both of Fed. Rep. of Germany

[73] Assignee: Sueddeutsche Kuehlerfabrik Julius Fr. Behr GmbH & Co., KG, Stuttgart, Fed. Rep. of Germany

[21] Appl. No.: 554,302

[22] Filed: Nov. 22, 1983

Related U.S. Application Data

[62] Division of Ser. No. 394,876, Jul. 2, 1982, Pat. No. 4,430,868.

[30] Foreign Application Priority Data

Sep. 14, 1981 [DE] Fed. Rep. of Germany ..... 3136374
Mar. 16, 1982 [DE] Fed. Rep. of Germany ... 8207265[U]

[51] Int. Cl.[3] ..... F25B 41/06

[52] U.S. Cl. ..... 62/515; 138/42; 165/174

[58] Field of Search ..... 62/515, 527, 511; 165/174; 138/42

[56] References Cited

U.S. PATENT DOCUMENTS 2,044,455 6/1936 Witzel .
2,099,186 11/1937 Anderegg .
2,803,116 8/1957 Tilney ..... 62/525
3,563,055 2/1971 Owens ..... 62/504
4,202,182 5/1980 Kawashima et al. ..... 62/527
4,244,194 1/1981 Haester et al. ..... 62/515
4,430,868 2/1984 Kern et al. ..... 62/515

FOREIGN PATENT DOCUMENTS 2847525 5/1980 Fed. Rep. of Germany .

*Primary Examiner*—Ronald C. Capossela
*Attorney, Agent, or Firm*—Schwartz, Jeffery, Schwaab, Mack, Blumenthal & Koch

[57] ABSTRACT

Disclosed is an evaporator comprising a connector member, a Venturi distributor connected to the connector member for receiving and distributing a coolant, wherein the Venturi distributor divides the coolant into a plurality of streams, a plurality of channels formed in a body which comprises an insert for the connector member for conducting the coolant streams from the Venturi distributor, the channels corresponding in number to the streams with each channel being positioned to receive one of the streams from the Venturi distributor, a plurality of evaporator pipes connected to the connector member in parallel flow arrangement, the pipes corresponding in number to the channels with each pipe being connected to one of the channels, thereby forming a continuous coolant flow path from the Venturi distributor via the channels to the evaporator pipes, and a collection chamber formed in the connector member for receiving the coolant from the pipes. Also disclosed is the use of the evaporator in air conditioners, particularly those of automotive vehicles.

22 Claims, 13 Drawing Figures

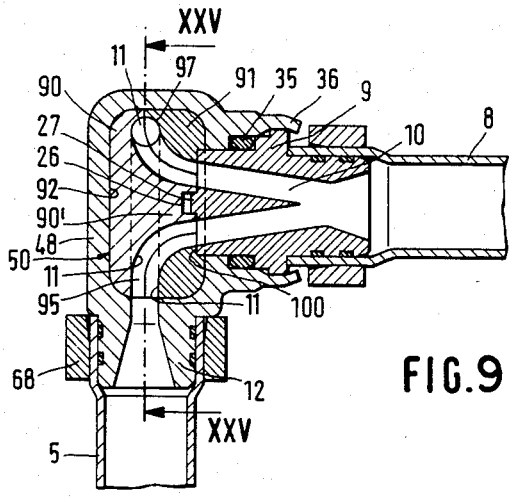
FIG.9
FIG.10
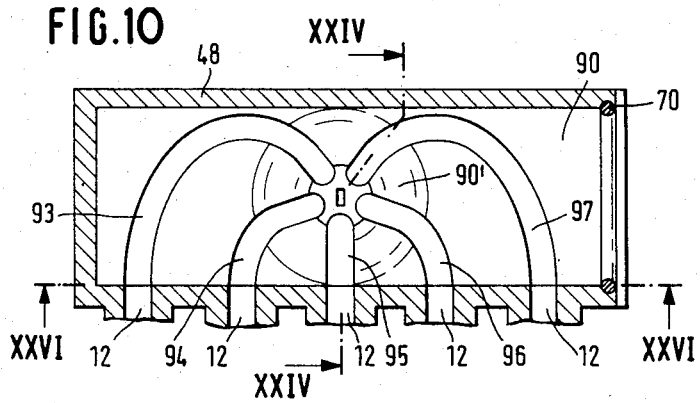
FIG.11
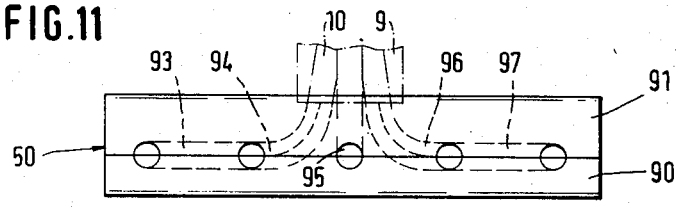

EVAPORATOR PARTICULARLY SUITABLE FOR AIR CONDITIONERS IN AUTOMOTIVE VEHICLES

This is a division of application Ser. No. 394,876, filed July 2, 1982 U.S. Pat. No. 4,430,868.

BACKGROUND OF THE INVENTION

The present invention relates to an evaporator, in particular for air conditioners in automotive vehicles.

An evaporator for air conditioners is described in DE-OS No. 28 47 525. The evaporator comprises an evaporator block containing a plurality of bifurcated pipes and cooler baffles, and a connector box or tank. A distributor chamber and a collector chamber are integrated in the connector box. The coolant is introduced by means of a coolant injector into the distributor chamber, flows through the U-shaped bifurcated pipes and is drawn off, after entering the collector chamber, through a compressor suction line.

In an evaporator of this type, all of the evaporator pipes consist of bifurcated pipes, each of which extends into the distributor chamber and into the collector chamber. All bifurcated pipes thus form evaporator pipes installed in parallel. In such a configuration, a uniform distribution of the coolant present in two phases with equal phase proportions in all of the parallel evaporator pipes is only adequately possible when the number of parallel evaporator pipes is very low. In view of capacity values customary in automotive vehicles, this means that the evaporator must be very slender and have very long bifurcated pipes. The structural space required for such a design is usually not available. Because the plurality of evaporator pipes are supplied by a common injector and distributor chamber, the cooling effect over the block volume is not uniform, since the flow of the coolant is distributed non-uniformly. This non-uniformity leads to a reduction in the performance of the evaporator.

A coolant flow distributor derived from the Venturi tube is described in U.S. Pat. No. 2,803,116. This distributor consists at its inlet side of a Venturi tube and at its outlet side of a plurality of outlet channels, having individual diameters smaller than the narrowest cross section of the Venturi tube. The outlet channels are arranged symmetrically on a conical surface. They form in the center of the Venturi tube a conical point. In known evaporators, distributor pipes are soldered into the outlet channels of the Venturi distributor and these are connected with the evaporator pipes, with the number of outlet channels corresponding to the number of evaporator pipes, consisting of several bifurcated pipes connected in series. In order to obtain the same flow resistance in all of the inlet pipes, they must be individually bent and aligned, resulting in high costs. The soldering of the bifurcated pipes and the functional testing required by it, are also cost intensive processes.

SUMMARY OF THE INVENTION

It is therefore an object of the present invention to provide an improved evaporator, particularly for use in automotive air conditioners.

Another object of the invention resides in providing such an evaporator which is simple in its configuration and economical to manufacture, and whereby a cooling effect uniformly distributed over the evaporator block can be obtained.

In accomplishing the foregoing objectives, there has been provided in accordance with the present invention an evaporator comprising a connector member or box, a Venturi distributor connected to the connector member for receiving and distributing a coolant, wherein the Venturi distributor divides the coolant into a plurality of streams, a plurality of channels formed in a body which comprises an insert for the connector member for conducting the coolant streams from the Venturi distributor wherein the number of channels corresponds to the number of streams, with each channel being positioned to receive one of the streams from the Venturi distributor, a plurality of evaporator pipes connected to the connector member in parallel flow arrangement, these pipes corresponding in number to the channels with each pipe being connected to one of the channels, thereby forming a continuous coolant flow path from the Venturi distributor via the channels to the evaporator pipes, and a collection chamber formed in the connector member for receiving the coolant from the pipes.

Further objects, features and advantages of the present invention will become apparent from the detailed description of preferred embodiments which follows, when considered together with the attached figures of drawing.

BRIEF DESCRIPTION OF THE DRAWINGS

In the drawings:

FIG. 9 is a cross-sectional view through a body carrying the channels with a rectangular cross section;

FIG. 10 is a cross-sectional view taken along the line XXV—XXV in FIG. 9;

FIG. 11 is a cross-sectional view taken along the line XXVI—XXVI in FIG. 10;

DETAILED DESCRIPTION OF PREFERRED EMBODIMENTS

Figure 1:
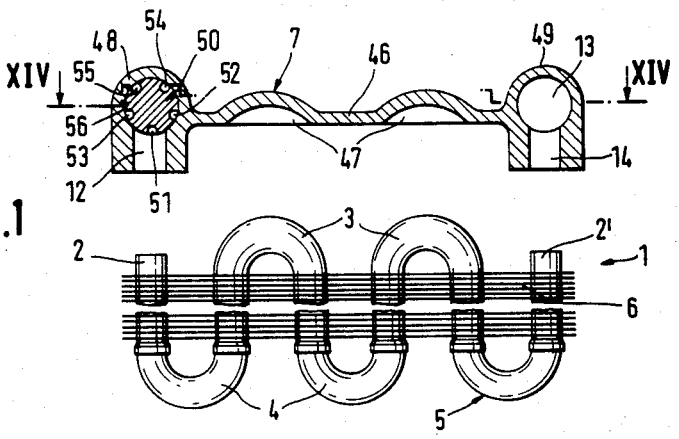
FIG. 1 is a cross-sectional view of a collector box designed as the distributor and the collector box.

An advantage of the evaporator according to the invention may be found in that the coolant streams, once distributed uniformly, are maintained over the entire length of the pipe, thereby assuring uniform evaporation in all of the pipes, resulting in a high degree of utilization and making possible the optimum dimensioning of the evaporator.

According to a preferred further development of the invention, the Venturi distributor has a number of outlet channels, arranged circularly and corresponding to the number of parallel evaporator pipes. The outlet channels are connected through the conduits with the individual evaporator pipes. In order to assure that the outlet channels of the Venturi distributor always coincide with the channels and to prevent rotation thereof with respect to the channels, the Venturi tube is arranged in an orifice of a housing in a positively secured manner and in such a manner that it cannot rotate.

In order to obtain the simplest arrangement of the connector box saving the most space, it is advantageous to arrange the channels between the Venturi distributor and the evaporator pipes radially and to terminate each of them in a connector fitting, to provide the collector chamber with a plurality of connector fittings and to fasten the evaporator pipes in the connector fittings in a coolant tight manner.

It is advantageous that the channels are provided in a body designed as an insert for the connector box, since they may be arranged therein in the simplest manner. The body is an easily processed workpiece which may be produced both by the injection molding process and by machining. This arrangement further represents an economical solution with respect to the necessary production tools. Furthermore, the weight of the connector box is substantially reduced.

According to an advantageous further development, the channels are formed by grooves arranged on the circumference of the body, the ends of which are placed on a line parallel to the cylindrical body. In this manner, the channels may be produced very simply and the configuration of the channels can be selected arbitrarily. In the installed state of the body, the channels are covered by the housing of the connector box, so that the channels are separated from each other. Advantageously, the Venturi distributor is arranged on the frontal side of the body, with the cone of the Venturi distributor, on the circumference of which the outlet channels are arranged, forming a single piece with the body, in order to integrate the structural parts. This integration of parts saves processing steps and reduces the number of gaps to be sealed.

The two-part configuration of the body makes it possible to arrange the channels inside the body, with the channels being provided in the form of grooves in one part and covered by the other part of the body, or as coinciding grooves in both parts of the body. By arranging the Venturi distributor in the center of the longitudinal extent of the body, the length of the channel to the most remote connector fitting is reduced by one half. In such a layout of the Venturi distributor, it is of advantage that the part of the body wherein the grooves are located has a distributor-and-baffle piece, in the circumference of which the outlet channels are arranged, while the inlet orifice of the Venturi distributor is provided in the other part. The distributor-and-baffle piece may also consist of a separate structural part, to be inserted upon fitting together the two parts of the body.

If for design reasons the channels are of different lengths and it is nevertheless desired that the same pressure drop be achieved in each, it is advantageous to provide the longer channels with a larger diameter than the shorter ones. In order to eliminate interfering effects in the collector chamber which appear as a function of the layout of the compressor suction line, the differential velocity profile in the collector chamber is compensated by adapting the diameters of the channels.

To further simplify the assembly with respect to production and to reduce the weight, it is advantageous to manufacture the connector box in two parts, wherein one part is laid out as the distributor box receiving the body with the channels and the other part as the collector box.

The fastening and sealing of the Venturi distributor can be effected in different ways. For a releasable connection, it is proposed that the Venturi distributor be fastened to the connector box by means of the beading or crimping of tabs or by means of a hollow threaded bolt and sealed with an annular gasket. A simple, non-releasable fastening of the Venturi distributor in the connector box, wherein no gasket is required, consists of adhesively bonding the Venturi distributor in the connector box. For this purpose, the Venturi distributor has a circumferential configuration to accommodate the needs of adhesive bonding technology. This may consist of a plurality of grooves extending in the circumferential direction or of knurling. The cavities formed by the grooves or the knurling accept the adhesive which effects the bonding and sealing. In the simplest possible configuration of the connector box, each of the evaporator pipes is fastened to the connector box at its beginning and at its end only. For this purpose, preferably each of the evaporator pipes consists of several bifurcations interconnected by pipe bends or elbows.

In order to eliminate connection of the bifurcated pipes by means of separate pipe elbows, it is advantageous to provide reversing channels in the connector box, whereby each of the reversing channels connects together two bifurcated pipes. For manufacturing reasons, the arrangement of reversing channels in single piece connector boxes is hardly possible. It is therefore of advantage to provide a two-part connector box, comprising a cover part and a bottom part, with the parting plane extending between the connector fittings and the reversing channels. This obviously requires a large joining surface between the cover part and the bottom part. The present invention also sets forth measures to increase the rigidity and tightness of the joint of the cover part and the bottom part.

If for some reason a multiple part connector box with large joining surfaces is undesirable, it is advantageous to provide a plurality of orifices in the connector box, arranged below the channels and transversely to them, with these orifices serving to receive the fingers of an insert. The reversing channels are located on the side of the fingers facing the connector fittings, with two connector fittings opening into the orifices in the area of each reversing channel. Measures to close the orifices by suitable means for the fastening and sealing of the insert are set forth in the detailed description below.

Numerous factors must be considered in the selection of material. Thus, it must be ascertained whether the material is impermeable to the coolant, i.e., in particular, fluorinated hydrocarbons must not diffuse through it. The workability, the price and the weight of the material are also of importance. For this reason, the connector box preferably consists of a fiber-reinforced polyamide or of aluminum. To prevent the diffusion of the coolant through the material, the connector box may be clad and/or jacketed with a layer of a material impermeable to the coolant.

Exemplary embodiments of the evaporator according to the invention are explained in detail hereinafter with reference to the drawings.

In FIG. 1 an evaporator is shown schematically. The evaporator comprises a plurality of evaporator pipes 5 consisting of the pipes 2, 2', bifurcated pipes 3 and pipe elbows 4, and the cooling fins 6 arranged transversely to the pipes 2 and bifurcated pipes 3. The pipes 2 in each case form the beginning and the end of the evaporator pipes 5 and are mounted in a distributor and collector box, designated hereafter as the connector box 7.

Figure 3:
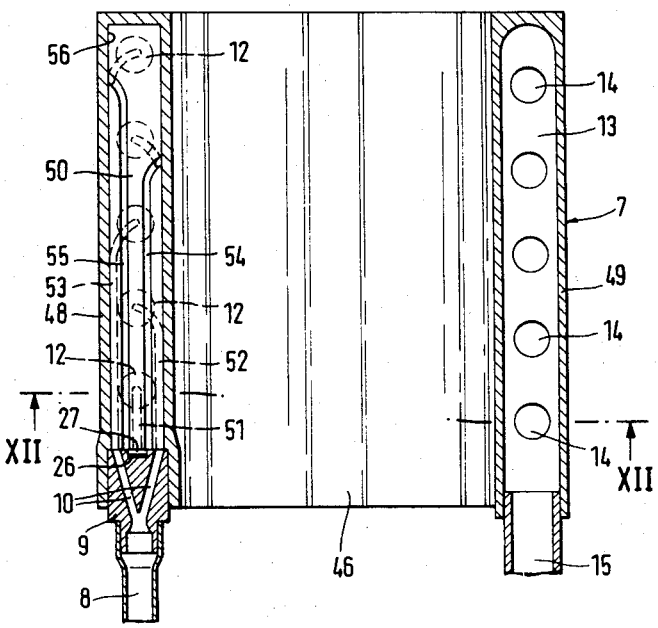
FIG. 3 is a cross-sectional view taken along the line XIV—XIV in FIG. 1.

As seen in FIG. 3, the connector box 7 has a coolant inlet 8, connected to the inlet side of a Venturi distributor 9. The Venturi distributor 9 has a plurality of outlet channels 10, with one outlet channel 10 provided for each evaporator pipe 5. The outlet channels 10 open into conducting channels, each of which is connected with one of the evaporator pipes 5 through a connector fitting 12 which receives a pipe 2.

In order to insure that the outlet channels 10 coincide with conducting channels 11, a recess 26 in the form of a rectangular or elongated hole is provided in the front side of the Venturi distributor 9 as security against rotation. This recess is engaged by a suitable projection 27 of the connector box 7, and a positive joint is thereby obtained. The pipe 2', forming the other end of the evaporator pipe 5, is secured in a connector fitting 14 and opens into a tubular collector chamber 13. The collector chamber 13 is connected with a compressor suction line 15.

FIG. 1 shows schematically an evaporator 1, consisting of a plurality of evaporator pipes comprising the pipes 2, 2', bifurcated pipes 3 and pipe bends or elbows 4, together with the cooling fins 6 arranged transversely to the pipes 2 and bifurcated pipes 3. The pipes 2 form both the beginning and the end of the evaporator pipes 5, which are mounted in a connector box 7. The connector box 7 comprises essentially a distributor box 48, a collector box 49 and an intermediate part 46, located between them. The intermediate part 46 is equipped with two recesses 47 to support the bifurcated pipes 3. The distributor box 48 has a bore 56, from which a number of connector fittings 12 corresponding to the number of evaporator pipes 5, issue. A body 50, in the form of an insert, is fitted into the bore 56; it has five grooves 51, 52, 53, 54 and 55, uniformly distributed over its circumference. The groove 51 is located in the area of the connector fitting 12 and opens into it. The other grooves 52 to 55 are covered by the wall of the distributor box 48. The collector box 49 has a collector chamber 13, into which open all of the evaporator pipes 5 fastened in the fitting 14.

Figure 2:
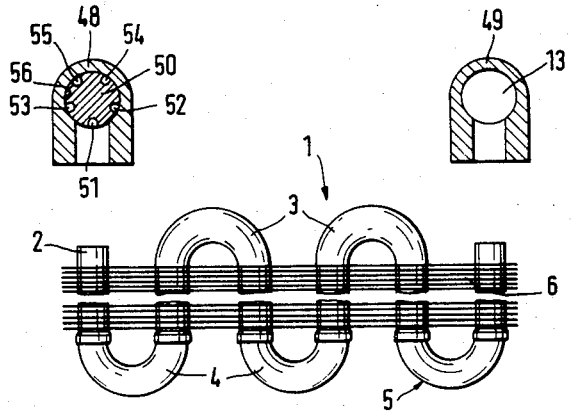
FIG. 2 is a cross-sectional view of an arrangement wherein the distributor box is separate from the collector box.

An arrangement similar to FIG. 1 is shown in FIG. 2; therefore similar parts are provided with identical reference symbols. In contrast to FIG. 1, in FIG. 2 the connector box is in two parts, so that the distributor box 48 is connected with the collector box 49 through the evaporator block only.

In FIG. 3, the connector box 7 is represented in a cross section along the line XIV—XIV in FIG. 1. It is seen that the bore 56 extends nearly over the entire length of the distributor box 48. The body 50 is located in the bore 56; it carries the grooves 51 to 56. A Venturi distributor 9 is mounted on the frontal side of the body 50, in the area of the bore inlet, and a coolant supply line 8 is connected with said Venturi distributor. The Venturi distributor 9 has several outlet channels 10, with one outlet channel 10 provided for each evaporator pipe 5. The outlet channels 10 open into the grooves 51 to 55, each of which leads to a connector fitting 12. In order to maintain the outlet channels 10 coincident with the grooves 51 to 55, a recess 26 is provided in a rectangular or elongated form on the frontal side of the Venturi distributor 9, to be engaged by a corresponding projection 27 on the frontal side of the body 50, whereby a positive joint is created as a security against rotation. To the right, the figure shows the collector box 49 with the collector chamber 13 and the connector fittings 14. A compressor suction line 15 is connected with the collection chamber 13. The compressor suction line may also be connected with the other end of the collector chamber 13. In this manner, differences in the pressure drop in channels 51 to 55 of different length may be compensated extensively. The line XII—XII indicates the section shown in FIG. 1.

Figure 4:
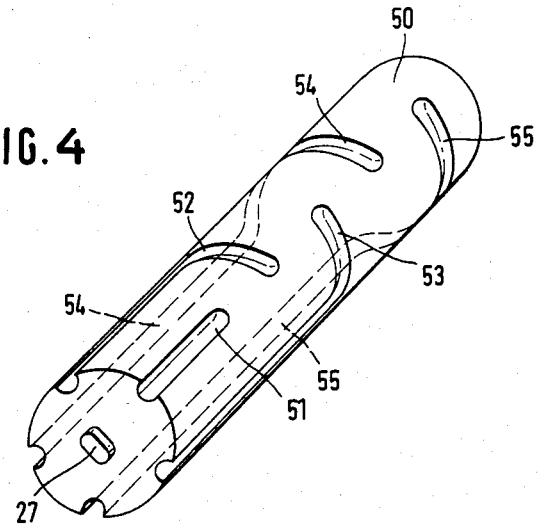
FIG. 4 is a perspective view of a body carrying the channels.

FIG. 4 shows a perspective view of the body 50 and of the grooves 51 and 55 arranged on its circumferential surface. It is seen that the grooves 51 to 55 are uniformly distributed at their onset over the cylindrical circumference of the body 50 and that they extend initially in the direction of the longitudinal axis of the body 50 and then proceed in the circumferential direction so that their ends are always located on the line axially parallel to the longitudinal axis of the body. Since the groove 51 already extends in the direction of the axially parallel line, it naturally has no part extending in the circumferential direction. In such an arrangement, the grooves 51 to 55 are of different lengths, with the groove 51 being the shortest and the groove 55 the longest. The projection 27 is visible on the frontal side of the body 50.

Figure 5:
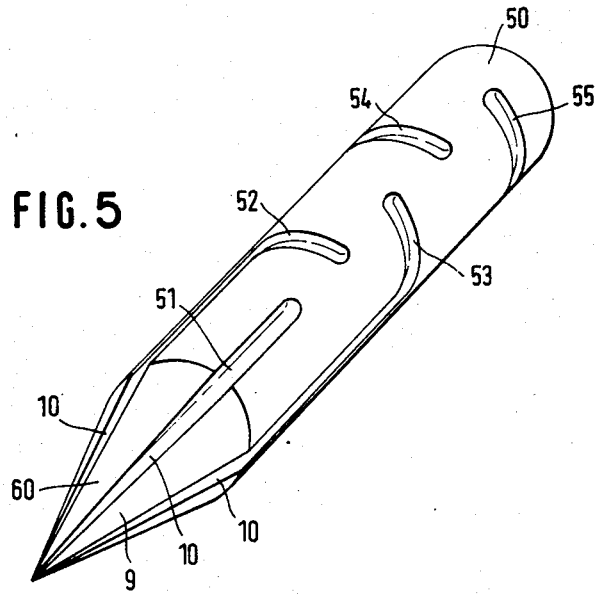
FIG. 5 is a perspective view of a body according to FIG. 4 with an integral Venturi distributor.

In FIG. 5, the body 50 is shown with the grooves 51 to 55, with a cone 60 being formed integrally with the body, on the side where the grooves 51 to 55 begin. The cone 60 is part of the Venturi distributor and carried on its circumferential surface the outlet channels 10, passing into the grooves 51 to 55.

Figure 6:
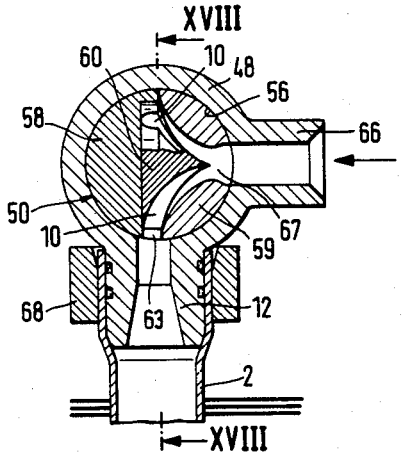
FIG. 6 is a cross-sectional view through a distributor box with a two-part body carrying the channels.
Figure 7:
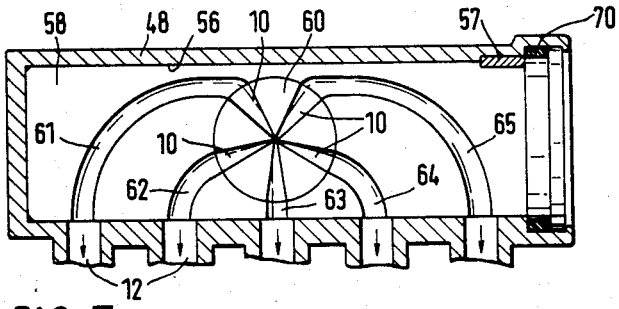
FIG. 7 is a cross-sectional view taken along the line XVIII—XVIII in FIG. 6.

FIG. 6 shows a section through a distributor box 48, equipped with a bore. The distributor box 48 has a fitting 66 for connection of a coolant inlet. A body 50 consisting of two parts 58 and 59 is located in the bore 56, into which a distributor and baffle piece 60 is inserted. The point of the distributor and baffle piece 60 protrudes into the inlet orifice 67 of the Venturi distributor, which is located in the part 59. The distributor and baffle piece 60 has several outlet channels 10 of the Venturi distributor, which—as seen in FIG. 7—pass into distributor channels. The outlet channel 10 leading in the downward direction opens into a groove 63 leading to the connecting fitting 12, which is arranged on the side of part 58 facing the part 59. A pipe 2 is fastened to the connector fitting 12 by means of a pressure plate 68.

In FIG. 7, a distributor box 48 is shown in a cross section on the line XVIII—XVIII in FIG. 6. It is seen that the connector fittings 12, which receive the evaporator pipes, are distributed uniformly over the length of the distributor box 48. In the center of the part 58, the distributor and baffle piece 60 is arranged, with the outlet channels 10 arranged in the form of a star on its circumference. The channels 10 open into channels formed by the grooves 61, 62, 63, 64, 65, leading to the connector fittings 12. The lengths of the grooves 61 to 65 differ, with the groove 63 being the shortest and the grooves 61 and 65 being the longest. By virtue of the central layout of the distributor and baffle piece 60 of the Venturi distributor, the grooves 61 to 65 may be made substantially shorter, with the grooves being only half as long as heretofore shown in FIG. 4. To insure that the ends of the grooves 61 to 65 always coincide with the orifices of the connector fittings 12, means to prevent rotation are provided; they consist of a key 57 engaging corresponding recesses in the distributor housing 48 and the part 58. A rubber ring 70 is provided for sealing against the atmosphere.

Figure 8:
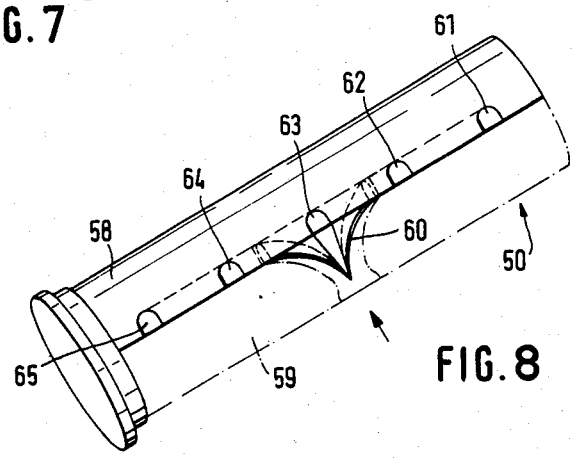
FIG. 8 is a perspective view of a two-part body.

FIG. 8 shows the body 50, consisting of the parts 58 and 59, in a perspective view. Broken lines indicate the location of the grooves 61 to 65 within the body 50. As seen in the figure, the grooves 61 to 65 are arranged in the parting plane of the body 50 with the part 58 and are covered by the part 59, thereby forming the channels to conduct the coolant.

FIG. 9 shows a distributor box 7 with the body 50 and the Venturi distributor 9. The distributor box 48 has a connector fitting 12 pointing downwardly, upon which an evaporator pipe 5 is placed and secured by means of a pressure ring 68. An orifice 92 is located in the distributor box 48; it has an essentially rectangular cross section with rounded corners. The body 50 is inserted into the orifice 92, and it consists of two parts 90 and 91 which together represent a cross-sectional shape corresponding to the orifice 92. The parting plane between the parts 90 and 91 extends in the longitudinal direction of the body 50, with an orifice being provided in the part 91, into which a projection 90' of the part 90 extends. The parts 90 and 91 are equipped with grooves aranged in the parting plane. Together they form the channels 11, having a circular cross section. In FIG. 9, the channel leading downwardly is designated as the groove 95, and the channel leading in the upward direction is designated as the groove 97. In the orifice of the distributor housing 48, a Venturi distributor 9 is inserted. It has outlet channels 10 and is connected on the inlet side with a coolant supply line 8. The Venturi distributor 9 is mounted by means of beaded or crimped tabs 36 in the distributor box 48 and is sealed by means of a gasket 35. The Venturi distributor engages a flat recess 100 of the body 50, and a rectangular or elongated orifice 26 is located in the recess 100, which is engaged by a corresponding projection 27 on the frontal side of the Venturi distributor 9.

FIG. 10 shows the distributor box 48 in a section along the line XXV—XXV in FIG. 9. The view shows that the connector fittings 12, accepting the evaporator pipes, are arranged uniformly over the length of the distributor box 48. In the center of the part 90, the round projection 90' is located, with the grooves 93–97 originating in a distributed manner over the circumference of the projection 90'; they lead to the connector fittings 12. The length of the grooves 93–97 differs, with the groove 95 being the shortest and the grooves 93 and 97 being the longest. A rubber gasket 70 is provided to seal the body 50 against the atmosphere. In FIG. 10, the line XXIV—XXIV indicates the section shown in FIG. 9.

FIG. 11 shows the body 50 consisting of the parts 90 and 91 along the line XXVI—XXVI in FIG. 25. The broken lines indicate the configuration of the grooves 93–97 within the body 50.

Figure 12:
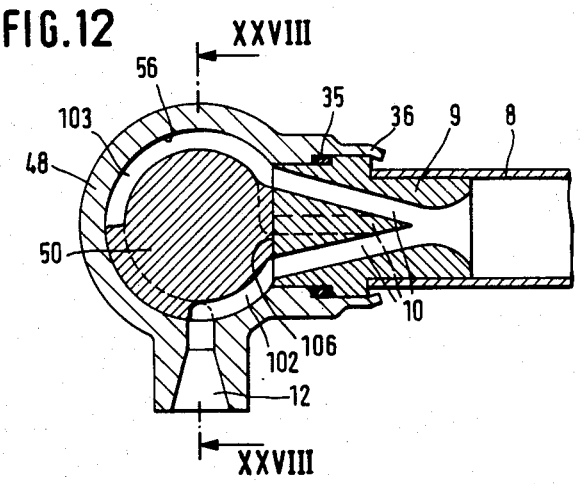
FIG. 12 is a cross-sectional view of a cylindrical body with helical channels.

FIG. 12 displays a distributor box 48 with a bore 56, wherein a cylindrical body 50 is arranged. The body 50 has a flattened location 106 on its side facing the Venturi distributor 9, against which said distributor rests. The grooves 102 and 103 extend along the circumferential surface of the body 50, and they lead to a row of connector fittings 12, aligned successively behind each other. The grooves 102, 103 are formed into the circumferential surface of the body 50 and are covered by the distributor box 48.

Figure 13:
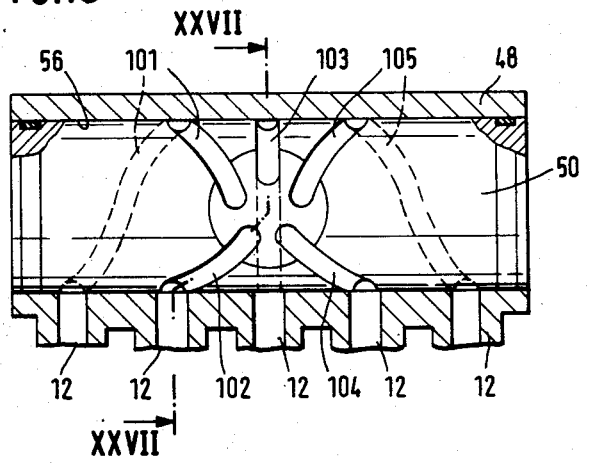
FIG. 13 is a cross-sectional view taken along the line XXVIII—XXVIII in FIG. 12.

In FIG. 13 a section along the line XXVIII—XXVIII in FIG. 27 is represented. The figure shows that five grooves 101–105 are present; they extend in the circumferential direction on the surface of the cylindrical body 50, with the grooves 101, 102, 104 and 105 having a helical configuration. All of the grooves 101–105 end in a common plane, in which the connector fittings 12 open into the bore 56. The section line XXVIII—XXVIII indicates the plane wherein FIG. 12 is represented.

What is claimed is:

1. An evaporator, comprising:

a connector member;

a Venturi distributor connected to said connector member for receiving and distributing a coolant, wherein said Venturi distributor divides said coolant into a plurality of streams;

a plurality of channels formed in a body which comprises an insert for said connector member for conducting the coolant streams from said Venturi distributor, said channels corresponding in number to said streams with each channel being positioned to receive one of said streams from said Venturi distributor;

a plurality of evaporator pipes connected to said connector member in parallel flow arrangement, said pipes corresponding in number to said channels with each pipe being connected to one of said channels, thereby forming a continuous coolant flow path from said Venturi distributor via said channels to said evaporator pipes; and a collection chamber formed in said connector member for receiving said coolant from said pipes.

2. An evaporator according to claim 1, wherein said body comprises an elongated configuration extending over the inlet ends of each of said evaporator pipes and means for fixing the position of said body in said connector member.

3. An evaporator according to claim 2, wherein said body comprises a cylindrical cross section.

4. An evaporator according to claim 2, wherein said body comprises a rectangular cross section.

5. An evaporator according to claim 2, wherein said Venturi distributor is arranged approximately in the center of said body.

6. An evaporator according to claim 5, wherein said body comprises two parts, with the parting plane extending in the longitudinal direction of said body.

7. An evaporator according to claim 6, wherein said channels comprise grooves arranged in said parting plane, said grooves being located in at least one part of said body and covered by the other part.

8. An evaporator according to claim 6, wherein said Venturi distributor is arranged within said body, said body comprising a first part having a distributor and a baffle piece and a plurality of outlet channels upon the circumferential surface and a second part comprising the inlet orifice for said Venturi distributor.

9. An evaporator according to claim 8, wherein said distributor and baffle piece comprises a separate structural part and is inserted between said parts of said body.

10. An evaporator according to claim 2, wherein said channels comprise grooves arranged in the circumferential surface of said body, the ends of all of said grooves being arranged on an axially parallel line of said cylindrical body.

11. An evaporator according to claim 10, wherein said Venturi distributor is located on the frontal side of said cylindrical body and comprises a cone being shaped as a single piece having said outlet conduits distributed over the conical surface area, and wherein said grooves extend, beginning at said outlet channels of said cylindrical body, initially in the longitudinal direction of said cylindrical body, with substantially at least some of said grooves extending in the circumferential direction of said cylindrical body.

12. An evaporator according to claim 10, wherein said grooves extend helically.

13. An evaporator according to claim 10, wherein said grooves extend circumferentially.

14. An evaporator according to claim 1, further comprising a plurality of connector fittings for connecting said channels to said evaporator pipes, and wherein all of said channels leading from said Venturi distributor to said connector fittings are of equal length and have the same cross-sectional area.

15. An evaporator according to claim 14, wherein said grooves comprise a suitably curved configuration in order to provide said equal length.

16. An evaporator according to claim 1, wherein said channels are of different lengths and wherein the longer channels have sufficiently larger diameters than the shorter channels to provide for an equal pressure drop over all of the channels.

17. An evaporator according to claim 1, wherein said connector member comprises two parts, one of said two parts comprising a distributor box for receiving said body and said other part comprises a collector box.

18. An evaporator according to claim 1, further comprising a compressor suction line, said suction line opening into said collection chamber for removing said coolant from said chamber.

19. An evaporator according to claim 1, wherein said connector member comprises a metal.

20. An evaporator according to claim 19, wherein said metal comprises aluminum.

21. An evaporator according to claim 1, wherein said connector member is clad or jacketed with a layer of a material impermeable to the coolant.

22. An air conditioning system for an automotive vehicle, comprising:

a compressor;

means for driving the compressor from the engine of the automotive vehicle; and an evaporator connected to said compressor, said evaporator comprising an evaporator as defined in claim 1.

* * * * *